United States Patent [19]

Fehrenbacher

[11] 4,357,898

[45] Nov. 9, 1982

[54] CARPET SHIELD

[76] Inventor: Daniel R. Fehrenbacher, 6420 W. VanBuren, Space D19, Phoenix, Ariz. 85043

[21] Appl. No.: 242,893

[22] Filed: Mar. 12, 1981

[51] Int. Cl.[3] ..... B05C 11/00

[52] U.S. Cl. ..... 118/504; 118/505; 428/80; 428/121; 428/177; 428/174

[58] Field of Search ..... 118/504, 505, 301; 427/282, 300; 428/80, 121, 130, 174, 177, 179, 192, 542

[56] References Cited

U.S. PATENT DOCUMENTS 4,051,808 10/1977 Trupp ..... 118/504

FOREIGN PATENT DOCUMENTS 724696 2/1955 United Kingdom ..... 118/504

*Primary Examiner*—George F. Lesmes
*Assistant Examiner*—Alexander S. Thomas
*Attorney, Agent, or Firm*—Don J. Flickinger

[57] ABSTRACT

A shield for protecting the nap, or pile, at the edges of carpets or the like while painting adjacent surfaces of adjoining walls. The shield is formed of a substantially planar isosceles trapezoidal guard and platform, and a substantially planar rectangular runner. The guard and runner support the platform above the upper surface of the carpet. The angles between the sides and major base of the guard and the angle between the guard and the platform are chosen so that the pile of the carpet does not, as the shield slides over the carpet, spring back into contact with adjacent painted wall surfaces. The guard, platform and runner are preferably made of a single sheet of planar material.

2 Claims, 3 Drawing Figures

FIG. 1
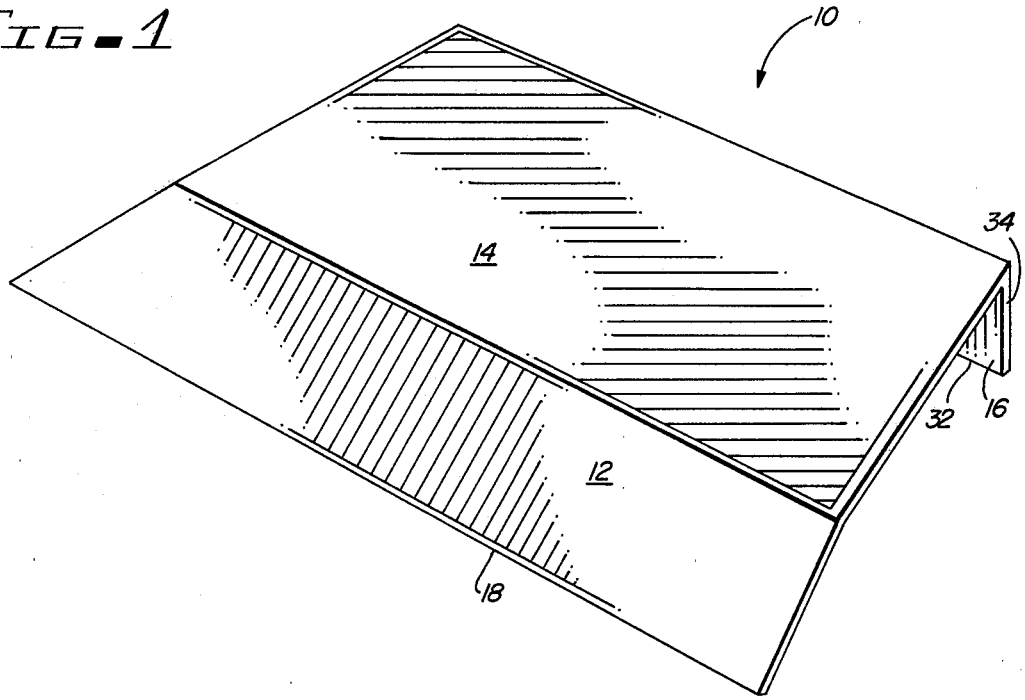
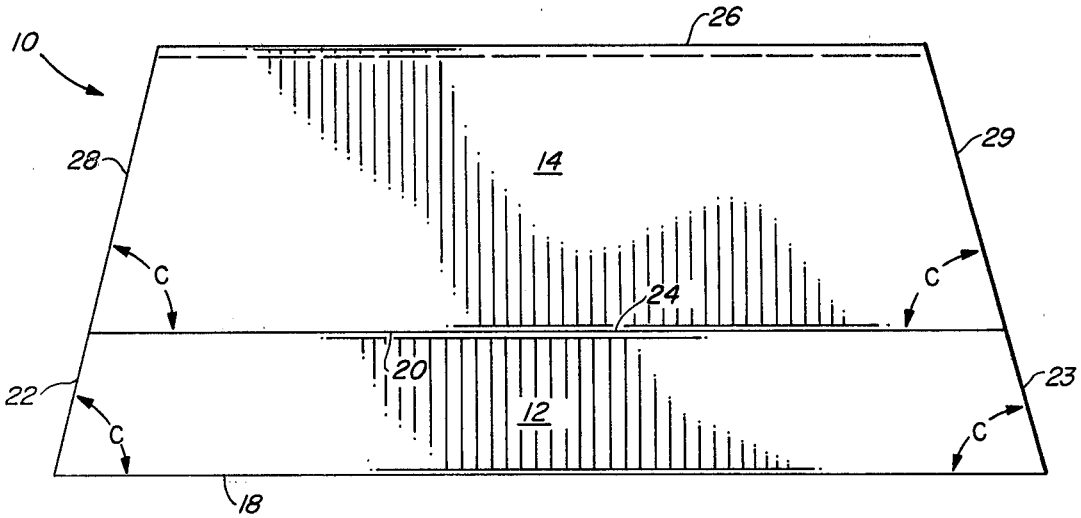
FIG. 2
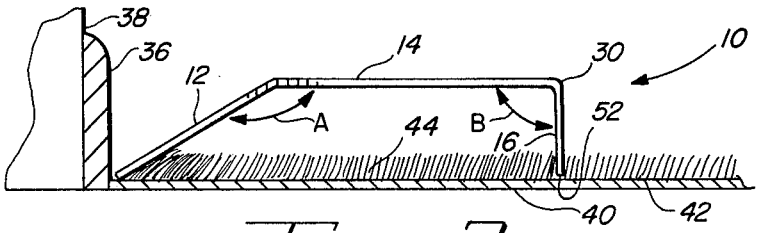
FIG. 3

CARPET SHIELD

BACKGROUND OF THE INVENTION

1. Field of the Invention

This invention is in the field of devices for shielding, or protecting, the pile of carpeting adjacent adjoining walls as such walls are being painted, or stained, or the like.

2. Description of the Prior Art

Paint shields for shielding the edges of carpets or the like while painting adjacent surfaces or adjoining walls are well known as shown, for instance, in U.S. Pat. No. 4,051,808. Prior art paint shields primarily provides a shield, or guard, that is substantially rectangular in plan view that will force the pile of the carpet away from the adjoining wall so that the paint can be applied to the wall without being applied to the rug, for example. The problem with prior art shields is that as the shields are slid along the upper surface of the carpet with one edge substantially in contact with an adjoining wall, the pile, or fiber, forming the upper surface of the carpet, as it comes out from under the shield will, because of the resiliency and the substantial length of the pile, tend to spring past vertical so that the pile comes into contact with the painted surface and thus paint will indirectly be applied to the pile at the edge of the rug adjacent the adjoining freshly painted, or stained, wall surface.

SUMMARY OF THE INVENTION

The present invention provides an improved shield for carpets which protects the edges of the carpet from picking up paint from an adjacent, adjoining wall surface to which paint, or stain, is being applied. The shield has a substantially planar and substantially isosceles trapezoidal guard which guard has two substantially equal sides and a major and a minor base. Extending from the minor base is a substantially planar and quadrilateral platform which may be a trapezoid having two sides and a major and a minor base. The platform extends at an angle from the guard with the minor base of the guard substantially coinciding with one side or the major base of the platform. A substantially planar and substantially rectangular runner which has two bases and two sides extends from another side of the platform. The guard and runner are dimensioned so that the platform will be substantially parallel to a plane determined by the major base of the guard and the other base of the runner or will be parallel to a parallel surface on which the runner and guard are positioned. The major base of the guard and the other base of the runner are also substantially parallel. The angle determined by the guard and the platform and by the sides and major base of the guard are chosen so that the piling of the rug, which has been bent over by the guard of the shield when no longer protected by the shield, as the shield is moved along the edge of the carpet, will gradually assume its normal, substantially vertical position and thus avoid coming into contact with the adjacent freshly painted surface. The preferrable angles between the sides and the major base of the guard is substantially 75° and the angle between the guard and platform is substantially 150°.

It is, therefore, an object of this invention to provide a carpet shield for shielding the pile at the edges of carpets or the like while painting adjacent surface of adjoining walls which minimizes the tendency of the piling of the carpet to spring into contact with the painted surfaces.

It is another object of this invention to provide an improved shield for carpeting which will protect the pile of the carpet and which will prevent the pile from coming into contact with freshly painted surfaces as the shield is slid along and over the surface of the carpet.

BRIEF DESCRIPTION OF THE DRAWINGS

Other objects, features and advantages of the invention will be readily apparent from the following description of a preferred embodiment thereof, taken in conjunction with the accompanying drawings although variations and modifications may be effected without departing from the spirit and scope of the novel concept of the disclosure, and in which:

FIG. 1 is a perspective view of the carpet shield of the present invention.

FIG. 2 is a plan view of the shield of FIG. 1.

FIG. 3 is a side view of the shield of FIGS. 1 and 2.

DETAILED DESCRIPTION OF THE INVENTION

In FIG. 1, carpet shield 10 has a substantially planar guard 12, a substantially planar platform 14 and a substantially planar runner 16. Guard 12 is substantially a trapezoid having a major base 18 and a minor base 20 and two equal sides 22, 23. Similarly, platform 14, in the preferred embodiment, is a trapezoid having a major base 24 and a minor base 26 as well as two substantially equal sides 28, 29. Runner 26 is preferrably a rectangle which has two bases 30, 32 and two sides, only one side of which, side 34, is seen in FIG. 1.

The angle A formed by guard 12 and platform 14 is, in the preferred embodiment, substantially 150°. The angle B formed by the platform 14 and runner 16 is substantially 90°. The angles C formed by the sides 22, 23 with the major base 18 of shield 12 and by the sides 28, 29 with the major base 24 of platform 14 are preferrably 75° as seen in FIG. 2.

In the preferred embodiment, the portions of carpet shield 10, namely guard 12, platform 14, and runner 16, are all preferrably made from the same piece of substantially planar sheet material. The particular material is of no particular significance but it should be relatively sturdy and impervious to paints, paint removers, paint thinners and the like. In particular, materials such as metals and plastics may be used. In the preferred embodiment, the shield 10 is made of a plastic nylon material.

In FIG. 3, the paint shield 10 is shown with major base 18 of guard 12 substantially in contact with wall moulding 36 which forms part of adjacent wall 38 of a room, for example. The carpeting 40, typically, has a backing 42 of woven jute, for example, and from the upper surface of backing 42 projects the pile 44. The length of the pile, particularly in shag or plush carpet, is approximately 5–8 tenths of an inch.

The dimensions of runner 16 and guard 12 are chosen so that platform 14 will be substantially parallel to a plane determined by the free side edge, or base 32 of runner 16 and the major base 18 of guard 12. In the preferred embodiment, the height of runner 16 is preferrably 1.5 inches. This height permits the user to hold or grasp shield 10 by his hand around either of the edges 28 or 29 of platform 14 to position shield 10 and to slide it along over the rug 40 with major base 18 of guard 12 in substantially contact with the lower portion of moulding 36 as seen in FIG. 3. It should be noted that the minor base of guard 12 coincides with one side, major base 24 of platform 14, and that the opposite side, or minor base 26 of platform 14 and the upper base or side of runner 16, substantially coincide.

In use, the shield 10 is placed substantially as illustrated in FIG. 3 with major base 18 of guard 12 in contact with the adjacent surfaces of adjoining wall 38, in this case in contact with moulding 36 substantially at floor level. The length of the guard 12 is such that the paint, stain, or whatever material that is to be applied to the moulding 36, can be applied without the means for applying the paint, stain, or whatever material from coming in contact with pile 44 of rug 40 adjacent the moulding 36. As the painting progresses, the user of carpet shield 10 will slide it along the surface of the carpet maintaining major base 18 in contact with the moulding 36. The angle that the guard 12 makes with the top surface of the rug is approximately 30° which bends the pile adjacent moulding 36 away from the moulding 36 as seen in FIG. 3. The slope of the sides 22, 23, as the shield 10 is slid along the surface, gradually bends the pile 44 over. There is no sudden sharp transition. As shield 10 moves, the pile 44 under shield 10 also is gradually permitted to resume its normal position with the pile 44 contacting one or the other of sides 22, 23 of guard 12 so that motion of the pile 44 is opposed, or damped, which significantly reduces the tendency of the pile 44 at the edge of carpet 40 adjacent moulding 36 from springing past vertical into contact with the freshly painted surfaces of moulding 36. As a result, the piling adjacent moulding 36 substantially does not contact moulding 35 and thus the pile 44 substantially avoids picking up paint or other materials applied to moulding 36. The only portions of the shield 10 to come in contact with rug 40 are the edge 18 of guard 12 and the base 32 of runner 16 so that the frictional forces opposing the sliding movement of shield 10 are minimized.

While platform 14, in the preferred embodiment, is an isosceles trapezoid, it could also be a quadrilateral figure such as a rectangle, square, or the like.

It should be evident from the foregoing that various modifications can be made to the described embodiment without departing from the scope of the present invention.

What is claimed is:

1. A shield for protecting the pile of carpeting while painting or staining adjacent surfaces of adjoining walls, said shield comprising:

a substantially planar substantially isosceles trapezoidal guard having two sides, a major base, and a minor base;

a substantially planar substantially isosceles trapezoidal platform having two sides, a major base and a minor base, said platform extending at an angle A from said guard with the minor base of the guard substantially coinciding with the major base of the platform;

a substantially planar and substantially rectangular runner having two bases and two sides, said runner extending at an angle B from the platform with one of the bases of said runner substantially coinciding with the minor base of said platform, said guard and said runner being dimensioned so that the free base of the runner is substantially parallel to the major base of the guard and the platform is substantially parallel to a plane determined by the major base of the guard and the free base of the runner, substantially only the major base of the guard and the free base of the runner are adapted to contact the carpeting when the shield is in use; and the angles C determined by the sides and major bases of the guard and the platform being substantially equal, whereby pile of the carpeting emerging from under the guard as the shield slides over the carpeting in a direction substantially parallel to the major base of the guard does not spring back past vertical.

2. A shield as defined in claim 1 in which the angle A substantially equals 150°, the angle B substantially equals 90°, and the angles C each substantially equals 75°.

* * * * *